US010464227B2

(12) United States Patent
Brormann

(10) Patent No.: US 10,464,227 B2
(45) Date of Patent: Nov. 5, 2019

(54) HAIRDRESSING RAZOR, RAZOR AND RAZOR HEAD

(71) Applicant: Frank Brormann, Oelde (DE)

(72) Inventor: Frank Brormann, Oelde (DE)

( * ) Notice: Subject to any disclaimer, the term of this patent is extended or adjusted under 35 U.S.C. 154(b) by 0 days.

(21) Appl. No.: 14/661,308

(22) Filed: Mar. 18, 2015

(65) Prior Publication Data

US 2015/0190937 A1 Jul. 9, 2015

Related U.S. Application Data

(62) Division of application No. 13/522,389, filed as application No. PCT/EP2011/000367 on Jan. 27, 2011, now abandoned.

(30) Foreign Application Priority Data

Jan. 27, 2010 (DE) ..... 10 2010 006 030

(51) Int. Cl.
*B26B 21/28* (2006.01)
*B26B 21/10* (2006.01)
(Continued)

(52) U.S. Cl.
CPC ..... *B26B 21/28* (2013.01); *B26B 21/10* (2013.01); *B26B 21/12* (2013.01); *B26B 21/16* (2013.01); *B26B 21/4075* (2013.01)

(58) Field of Classification Search
CPC ..... B26B 21/28; B26B 21/4075; B26B 21/16; B26B 21/12; B26B 21/10; B26B 21/125
See application file for complete search history.

(56) References Cited

U.S. PATENT DOCUMENTS 1,365,176 A * 1/1921 Knudtson ..... B26B 21/10 30/332
1,553,449 A * 9/1925 Kennedy ..... B26B 27/005 30/2
(Continued)

FOREIGN PATENT DOCUMENTS

DE 476 129 C 5/1929
FR 803682 A * 10/1936 ..... B26B 21/28
(Continued)

OTHER PUBLICATIONS

International Search Report of International Application No. PCT/EP2011/000367, dated May 10, 2011.

*Primary Examiner* — Jonathan G Riley
(74) *Attorney, Agent, or Firm* — R. Dabney Eastham

(57) ABSTRACT

A hairdressing razor for cutting hair having an elongated handle and a cutting head joined to the handle, wherein at least one blade holder for at least one blade is provided in the cutting head. In order to achieve an improved cutting result and a longer blade service life, the invention provides for the longitudinal axis of the blade to be arranged at an angle to the longitudinal axis of the cutting head. A single recess is provided on at least one longitudinal side of the cutting head into which recess a free cutting region of projects without extending beyond the longitudinal edge of the longitudinal side when a blade is located in the blade holder, and wherein a length of the recess is smaller than half the length of the longitudinal side and wherein a length of the free cutting region in the recess is smaller than 15 mm.

11 Claims, 6 Drawing Sheets

(51) Int. Cl.

| | |
|---|---|
| ***B26B 21/12*** | (2006.01) |
| ***B26B 21/16*** | (2006.01) |
| ***B26B 21/40*** | (2006.01) |

(56) References Cited

U.S. PATENT DOCUMENTS 1,666,118 A * 4/1928 Colgrove ..... B26B 5/006 30/169
1,814,596 A * 7/1931 Hamel ..... B26B 5/006 16/88
1,997,992 A * 4/1935 Bates, Jr. ..... B26B 5/006 30/317
2,254,199 A * 9/1941 Baltuch ..... B26B 5/006 30/289
2,624,116 A * 1/1953 Steinke ..... B26B 5/006 30/320
2,853,778 A * 9/1958 Pratt ..... B26B 5/006 30/294
3,106,020 A * 10/1963 Tape ..... B26B 21/12 30/30
3,570,121 A 3/1971 Graceffo
4,631,829 A * 12/1986 Schmidt ..... B26B 5/006 30/2
6,263,576 B1 7/2001 Drapak et al.
7,533,595 B2 * 5/2009 Domenico ..... B26B 3/08 30/286
2003/0196330 A1 * 10/2003 Kitano ..... B26B 21/10 30/53
2018/0222069 A1 * 8/2018 Brormann ..... B26B 21/10

FOREIGN PATENT DOCUMENTS

| | | | | |
|---|---|---|---|---|
| FR | 2 849 618 A1 | 7/2004 | | |
| GB | 469720 A * | 7/1937 | ..... | B26B 21/28 |
| GB | 2 357 057 A | 6/2001 | | |
| WO | 96/11777 A1 | 4/1996 | | |
| WO | 2005/113203 A1 | 12/2005 | | |

* cited by examiner

HAIRDRESSING RAZOR, RAZOR AND RAZOR HEAD

CROSS REFERENCE TO RELATED APPLICATION

This application is a division of commonly owned, co-pending U.S. patent application Ser. No. 13/522,389, filed Jul. 16, 2012, which is a § 371 of PCT/EP2011/000367 filed Jan. 27, 2011.

BACKGROUND OF THE INVENTION

Field of the Invention

The invention relates to a hairdressing razor for cutting of hair, especially hair on the head, with an elongated handle and a cutting head which is connected to the handle, in the cutting head, there being at least one blade holder for at least one blade.

Description of Related Art

A hairdressing razor of the initially named type is already known from practice. In the hairdressing razor known from practice, the longitudinal axis of the blade, and thus, the cutting edge which runs parallel to the longitudinal axis of the blade, runs parallel to the longitudinal axis of the cutting head. When using a sharp blade, the cutting result which is achieved with the known hairdressing razor is relatively good. In any case, after a relatively short time of use, a deterioration of the cutting result can be ascertained; this often leads to replacement of the old blade by a new blade.

SUMMARY OF THE INVENTION

A first object of this invention is to provide a hairdressing razor of the initially mentioned type with which improved cutting results can be achieved.

To achieve a good cutting result, this invention provides that the longitudinal axis of the blade is located at an angle to the longitudinal axis of the cutting head. In mechanical terms, associated with the angled arrangement of the longitudinal axes to one another, is the fact that the blade holder is located obliquely relative to the cutting head. Thus, ultimately, the angled arrangement of the blade with respect to the cutting head yields an oblique arrangement of the blade; when cutting hair, this leads to a smoother, cleaner cut. In principle, this can be compared to the cut of a guillotine.

In conjunction with the oblique arrangement of the blade relative to the cutting head, it has been ascertained that the angle between the longitudinal axes should be between 0.1° and 10°. Preferably, the angle is between 0.5° and 6° and especially between 2° and 4°. Ultimately, therefore, a relatively small incline is sufficient to achieve a good cutting result.

Moreover, the small incline has the advantage that does not require the cutting head need to be widened, or at the most only slightly widened, as compared to an arrangement with parallel or coaxial axes.

Preferably, the cutting head itself should have the shape of an elongated rectangle. Here, the length can be roughly twice as great as the width, while the thickness of the cutting head should preferably be only a quarter of the width of the cutting head.

In order to be able to easily insert the blade into the blade holder, the cutting head should have a lower cutting head part which is connected to the handle, and an upper cutting head part, between the cutting head parts then the blade holder being formed. In this embodiment, the cutting head parts can move relative to one another and can be connected to one another. In this regard, it can be provided that the upper cutting head part is made as a separate component and can be detachably connected to the lower cutting head part. There can be catch connections, spring hooks or the like for the detachable connection. Alternatively, it is possible for the upper cutting head part to be articulated to the lower cutting head part. In this case, the blade holder is then accessible by a part being pivoted up in order to reach the blade holder or the blade.

In another embodiment, the cutting head is made inherently in one piece, an insertion slot being provided which discharges into the blade holder and via which the blade can be pushed in. In order to be able to remove an inserted blade from the blade holder again, there is then preferably an actuating means for at least partially pushing the blade out of the cutting head. In this connection, for example, it can be a spring-loaded thrust element which in the region of the cutting head and/or of the handle is provided with an action element to which pressure can then be correspondingly applied.

It is now provided for the hairdressing razor, in addition, that the length of the recess is smaller than half the length of the longitudinal side of the cutting head and that the length of the free cutting region in the recess is smaller than 15 mm. In conjunction with this invention, it has been recognized that, for exact cutting, fundamentally a recess which has been made much smaller than in the prior art on the longitudinal side is necessary. The recess which has been made smaller in accordance with the invention allows a strand to be cut much more precisely, miscuts being considerably reduced.

Furthermore, it has been ascertained that the length of the free cutting region in the recess should be smaller than 15 mm. Preferably, the length is smaller than 10 mm and larger than 1 mm, preferably being between 3 mm and 8 mm. Cutting regions which have been made in this way, however, offer not only the possibility of a defined cut, but they also otherwise ensure that it is hardly possible during handling to reach into the cutting region. As a result, unintentional injuries can at least be essentially precluded.

In this connection, it is of special importance that the maximum overhang of the cutting region into the recess be smaller than 3 mm, especially smaller than 2.5 mm and preferably smaller than 2 mm. Ultimately, the cutting region therefore projects only quite slightly into the recess. Otherwise, there should also be a distance between the cutting region, by which the outer cutting edge of the blade is meant, and the longitudinal edge of the longitudinal side of the cutting head. The greatest clear, vertical, distance should be larger than 1 mm, preferably larger than 1.5 mm and especially between 1.6 and 3 mm. Due to the aforementioned features the cutting edge of the blade is set back relative to the longitudinal edge of the outer side, the cutting region ultimately projecting only minimally into the recess.

To achieve a guided movement of the hair into the recess, in accordance with the invention, it is provided that the recess be made corrugated. To avoid unnecessary edges in this connection, it is especially recommended that the transition from the longitudinal edge of the longitudinal side to the recess be rounded. This ultimately relates to the two transitions of the recess to the longitudinal edge of the longitudinal side.

Otherwise, it goes without saying that it is also fundamentally possible, instead of a corrugated shape or U-shape, to choose a V-shaped recess. In any case, it is important that the region of the recess runs obliquely from the longitudinal edge of the longitudinal side to the cutting region.

Based on the aforementioned configuration, the maximum length of the recess is greater than the length of the free cutting region. Preferably, the length is greater at least by a factor of 1.2 than the length of the free cutting region. Preferably, the length of the recess is greater than the length of the free cutting region by a factor between 1.5 and 3.0.

In conjunction with this invention, it has otherwise been ascertained that special advantages accrue in handling by there being likewise only one further recess on the longitudinal side of the cutting head, into which recess a free cutting region of a blade projects without overhanging the longitudinal edge of the other longitudinal side. The implementation of another recess on the other longitudinal side makes to possible to easily cut, instead of only in one direction, also in the other direction. Moreover, the other cutting region can also be used when the cutting region in the first recess has become dull.

Especially when the cutting head has only one recess on each of the two sides, it is especially advantageous to provide only one blade in the cutting head for the two recesses, the blade preferably having one cutting region on the two longitudinal sides, and otherwise, a middle longitudinal opening. In this connection, it is ultimately a standard razor blade, which is available, for example, as a TCR blade. Since they are standard blades here, use in conjunction with the hairdressing razor in accordance with the invention is recommended, in particular since a new blade is used at least for each cutting process.

In order to be able to easily use one blade, even for two cutting processes, the recess should be off-center on the longitudinal side. The off-center arrangement makes it possible to remove a blade from the blade holder after one cutting process and to turn it so that a previously unused cutting region of the blade can then be used.

Otherwise, in this connection, it is also recommended that the recesses on opposite sides of the cutting head be arranged offset to one another. Then, one recess is located in the region of the upper half of the cutting head, while the recess which is located on the other side of the cutting head is in the region of the lower half This arrangement otherwise has advantages in handling with the hairdressing razor in accordance with the invention since it is easily possible, while cutting, to turn the razor in the hand so that cutting regions different relative to the length of the cutting head are available on the cutting head.

It is pointed out that all information about regions cited above and below encompasses all intermediate regions and individual values which lie between the region borders and they are regarded as critical to the invention, even if the intermediate regions and individual values are not given specifically.

Moreover, the invention relates to a shaving razor for cutting of body hair, with an elongated handle and a shaving head which is permanently connected to the handle or which can be detachably connected, there being at least one blade in the shaving head.

Shaving razors of this type which are conventionally so-called disposable razors have long been known from practice. In the known shaving razors it is conventionally such that the handle and the shaving head are arranged at a right angle to one another. The blade which cannot be replaced and which is located generally permanently in the shaving head and its cutting edge run likewise at a right angle to the longitudinal axis of the handle.

Extensive work has been done in the past on the improvement of the shaving quality of shaving razors. Thus for example a plurality of blades instead of a single blade has been proposed, as have changes of the cutting edge geometry of the blade.

In spite of all efforts the shaving result has not been satisfactory in certain applications and for certain types of skin, as before.

Another object of this invention is therefore also to make available a shaving razor of the aforementioned type with which a better shaving result is achieved.

This object is achieved in a shaving razor of the aforementioned type which is especially a disposable razor in accordance with the invention in that the longitudinal axis of the handle is located at an angle not equal to 90° to the cutting edge of the blade. In conjunction with this invention it has been ascertained that the arrangement of the cutting edge of the blade at an angle not equal to 90° to the longitudinal axis of the handle, which is hereinafter called an oblique arrangement of the blade, leads to a smooth and clean cut of hair during shaving. Ultimately the oblique arrangement during shaving yields not only a vertical cutting component, but also a horizontal one; this benefits the cut and thus the shaving result. Ultimately, in the shaving razor in accordance with the invention the same principle as in the case in the initially described hairdressing razor is used.

The inclination of the cutting edge relative to the longitudinal axis of the handle at an angle not equal to 90° can be implemented by two fundamental possibilities which are possible for themselves, but also in combination with one another.

In one alternative, the longitudinal axis of the shaving head is at a right angle to the longitudinal axis of the handle. Here, the cutting edge is then at an angle to the longitudinal axis of the shaving head. This angle is preferably between 0.1° and 25°, preferably between 0.5° and 6°, and especially between 1° and 4°. Otherwise, it goes without saying that any individual value within the aforementioned boundaries, and also any intermediate region is possible (and can be regarded as critical to the invention) even if this is not indicated in particular.

In the other alternative, the longitudinal axis of the shaving head is located at an angle not equal to 90° to the longitudinal axis of the handle while the cutting edge is located parallel to the longitudinal axis of the shaving head. In the latter alternative, the angle between the longitudinal axis of the handle and the longitudinal axis of the shaving head is between 89.9° and 65°, preferably between 89.5° and 84°, and especially between 89° and 86°. In this connection, each individual value and each intermediate interval is possible within these boundaries, even if this is not indicated specifically. Regardless of this, all individual values and all intermediate intervals within these boundaries should be considered disclosed as being critical to the invention.

In all embodiments, therefore depending on whether the shaving head is now at a right angle to the handle, which is inherently preferred, or not, it is however such that the angle between the longitudinal axis of the handle and the cutting edge is in the aforementioned region of values, therefore between 89.9° and 65°, preferably between 89.5° and 84°, and especially between 89° and 86°.

Furthermore the invention relates to a shaving head for a razor for cutting of body hair, especially for a razor of the aforementioned type, for detachable connection to an elongated handle, in the shaving head there being at least one blade.

One such shaving head, which as a result is an interchangeable (disposable) shaving head with a blade or blade arrangement which cannot be replaced and which is arranged fixed, in accordance with the invention, is made such that the cutting edge is located at an angle to the longitudinal axis of the shaving head, the above described angle geometry likewise being given in a ratio of the cutting edge to the longitudinal axis of the shaving head.

Otherwise, it goes without saying that those shaving heads are also encompassed by this invention in which the cutting edge runs parallel to the longitudinal axis of the shaving head, the incline then being achieved by the detachable connection between the handle and the back of the shaving head.

Other features, advantages and possible applications of this invention will become apparent from the following description of exemplary embodiments with reference to the accompanying drawings, and from the drawings themselves. Here all described and/or illustrated features by themselves or in any combination form the subject matter of this invention.

DETAILED DESCRIPTION OF THE INVENTION

Figure 1:
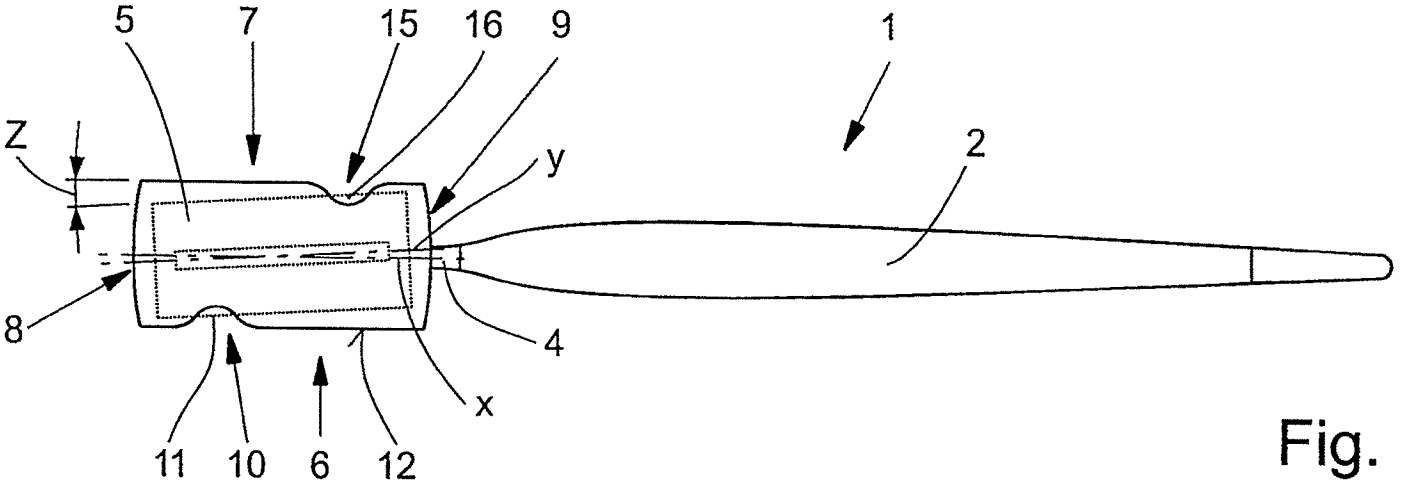
FIG. 1 shows a plan view of the hairdressing razor in accordance with the invention.
Figure 2:
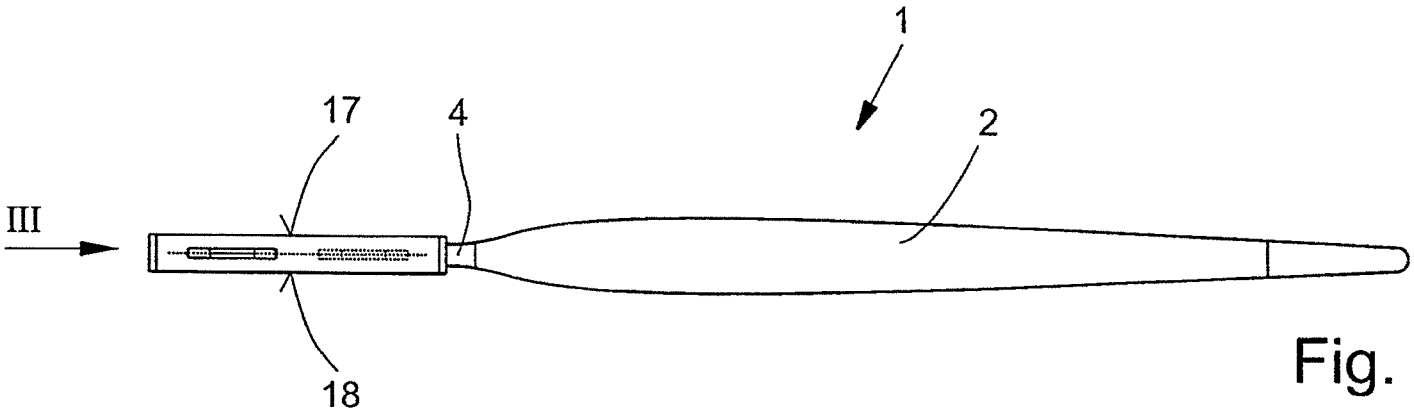
FIG. 2 shows a side view of the hairdressing razor from FIG. 1.

The figures each show hairdressing razors 1 for cutting of hair. Preferably, hairdressing razors 1 of this type are used for cutting of hair on the head. In all embodiments, the hairdressing razor 1 has an elongated handle 2. The handle 2, which can be made of any material, especially of plastic, metal or wood, is connected to a cutting head 3. Between the handle 2 and the cutting head 3, there is a connecting region 4 which constitutes the transition from the handle 2 to the cutting head 3. The shape of the connecting region 4 is optional. However, fundamentally, it is possible for the handle 2 to pass directly into the cutting head 3. The length of the handle 2—without the connecting region 4—is several times larger than the length of the cutting head 3. Here, the handle is more than three times as long as the cutting head 2. Otherwise, the handle 2 has an elongated conical shape that tapers toward a point at distal the end.

In the cutting head 3, there is a blade holder for at least one blade 5 which is only shown in dotted lines. In terms of dimensions with regard to length and width, the blade holder corresponds at least essentially to the corresponding dimensions of the blade 5, there being corresponding stops (not shown) which prevent displacement of the blade 5 in the blade holder while handling the hairdressing razor 1. Ultimately, the blade 5 is fixed in the blade holder in the inserted state.

The cutting head 3, as follows from the individual figures, has the shape of an elongated rectangle. Here, the length is roughly twice as great as the width, while the thickness is roughly one fourth of the width of the cutting head 3. The cutting head 3 has a first longitudinal side 6, a second longitudinal side 7, a front end face 8 and a back end face 9. The connecting region 4 is connected to the back end face 9.

In the illustrated embodiments, at this point, it is such that there is only one recess 10 on the first longitudinal side 6 of the cutting head 3. A free cutting region 11 of the blade 5 projects into the recess 10, without the free cutting region 11 extending beyond the longitudinal edge 12 of the longitudinal side 6. Furthermore, the length L of the recess 10 is smaller than half the length of the longitudinal side 6. Moreover, the length l of the free cutting region 11 in the recess 10 is smaller than 15 mm. For the exemplary embodiment which is shown in FIGS. 1 to 4, the length l of the free cutting region 11 is roughly 6.8 mm. This applies in the same way to the embodiment shown in FIGS. 5 to 7. In the embodiments according to FIGS. 8 & 9, the length l of the free cutting region 11 is somewhat smaller. It is roughly 5.6 mm there.

Figure 4:
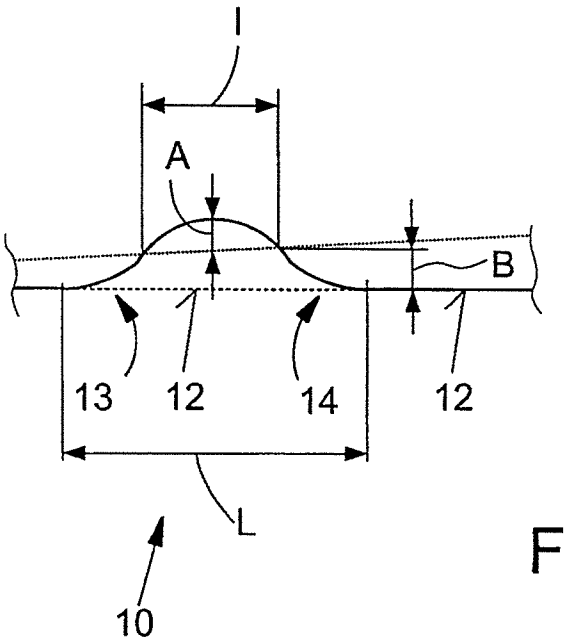
FIG. 4 shows an enlarged detail of the cutting head of the hairdressing razor from FIG. 1.
Figure 8:
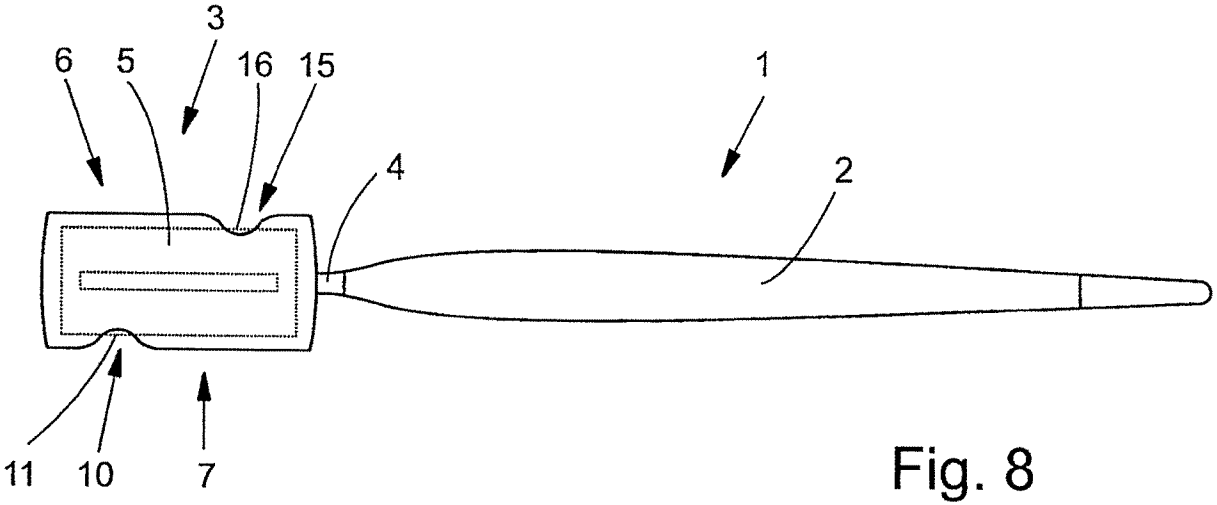
FIG. 8 shows a plan view of a third embodiment of a hairdressing razor in accordance with the invention.
Figure 9:
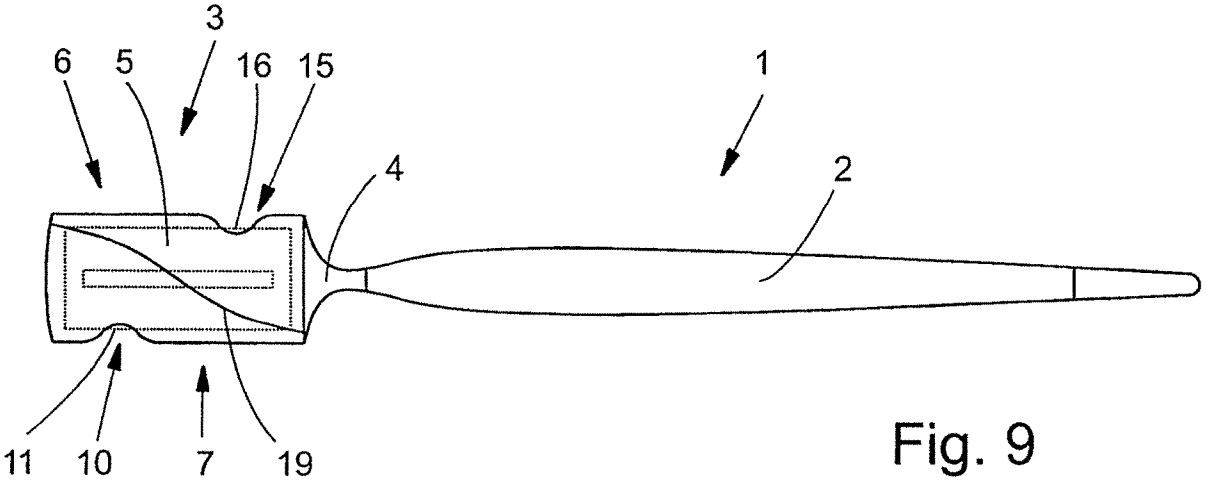
FIG. 9 shows a plan view of a fourth embodiment of a hairdressing razor in accordance with the invention.

As follows especially from FIG. 4, the maximum extension A of the cutting region 11 into the recess 10 is smaller than 3 mm. In the illustrated embodiments shown in FIGS. 1 to 4, on the one hand, and 5 to 7 on the other, the extension A is roughly 1.7 mm, while it is roughly 1 mm in the embodiments as shown in FIGS. 8 & 9. The maximum perpendicular distance B of the cutting region 11 relative to the longitudinal edge 12 is greater than 1 mm here. This distance is between 1.5 and 15 mm in the illustrated exemplary embodiments.

The recess 10 is, itself, is sinuous, having the shape of a valley of a sine wave. Otherwise, the two transitions 13, 14 are rounded from the longitudinal edge 12 to the recess 10. In this way, an edge-free or continuous transition from the longitudinal edge 12 into the recess 10 arises. In any case, the length of the recess 10, itself, is greater than the length of the free cutting region 11. In one preferred embodiment the factor is roughly 2.

In all embodiments, there is another recess 15 on the second longitudinal side 7 of the cutting head 3 into which a free cutting region 16 of the blade 5 likewise projects. The formation of the other recess 15 corresponds to the formation of the first recess 10. The dimensions of the free cutting region 16 with reference to the recess 15 correspond to the dimensions of the recess 10 and of the free cutting region 11, as is shown in FIG. 4.

Otherwise, in all embodiments, it can be recognized that, on each longitudinal side 6, 7, there is only one single recess 10, 15. The two recesses 10, 15 are located off-center relative to the length of the cutting head 3, so that an offset arrangement of the recesses 10, 15 results on the opposite sides of the cutting head 3.

While it is fundamentally possible to provide a separate blade 5 for each of the recesses 10, 15, in the illustrated embodiments, there is only a single, double edge blade 5 which extends into both the recesses 10, 15. This is indicated only schematically. Ultimately, it is a standard blade 5 which has cutting regions on its two longitudinal sides and which has an elongated slot in the middle. The schematically shown blade 5 should ultimately constitute a conventional standard blade of the type that has been used for decades in razors, for example, as is available from Gillette®. In the inserted state, the blade is fixed in position in the blade holder so that movement in the plane of the blade is not possible.

In the embodiments which are shown in FIGS. 1 to 7, the longitudinal axis Y of the blade 5 is located at an angle to the longitudinal axis X of the cutting head 3. As a result, this means that the blade holder is arranged accordingly obliquely to the cutting head 3. Here, the angle Z between the two longitudinal axes X and Y is roughly 3°. Conversely the longitudinal axes X and Y in the embodiments according to FIGS. 8 & 9 are coaxial or parallel to one another. In completed tests, it was ascertained that a much improved cutting result can be achieved when the blade 5 is inclined.

It is shown that the cutting head 3 is made in two parts, having a lower cutting head part 3*a* which is connected to the handle 2, and a separate upper cutting head part 3*b*. The upper and lower cutting parts 3*a*, 3*b* are connected to one another via elastic inner hooks. The blade holder 3*c* is located between the two cutting head parts 3*a*, 3*b*. To insert or remove a blade 5 from the blade holder 3*c*, the upper cutting head part 3*b* is detached from the lower cutting head part 3*a* and removed so that a blade 5 can be inserted. The spring hooks can be located in the region of the opening of the blade.

Otherwise, it is possible to provide an insertion slot in the region of the front end face 8 of the cutting head 3, the slot opening into the blade holder and into which the blade 5 can be pushed from the outside, In this case, the cutting head is made in one piece. To remove a blade from the blade holder, a pushing mechanism is used which can be actuated from the outside via an actuating means. The actuating means can be located in the region of the cutting head and/or of the connecting region and/or of the handle.

Figure 3:
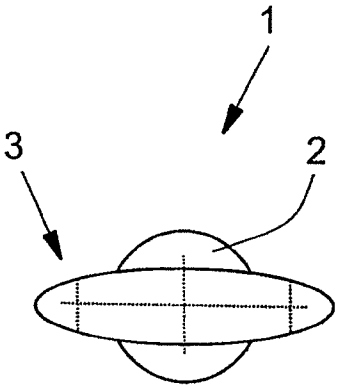
FIG. 3 shows a view in the direction of arrow III in FIG. 2.
Figure 5:
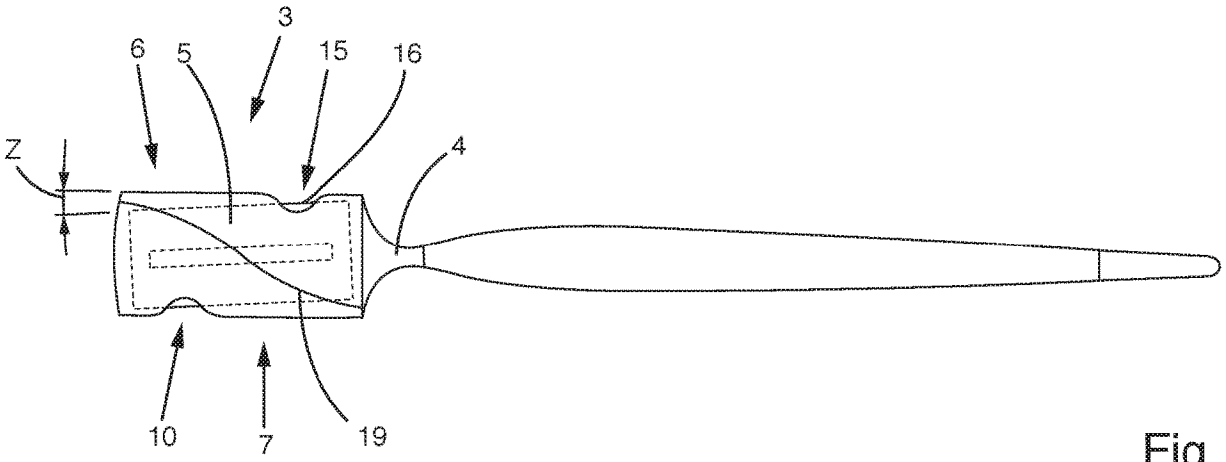
FIG. 5 shows a plan view of a second embodiment of a hairdressing razor in accordance with the invention.
Figure 6:
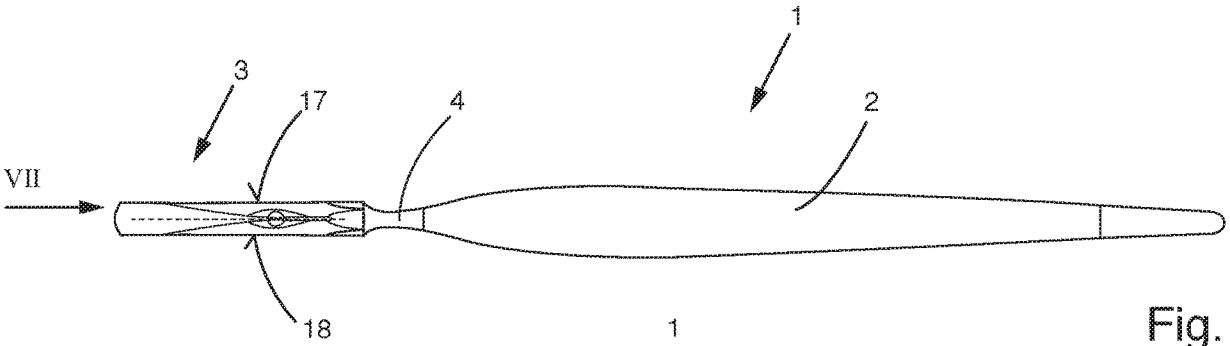
FIG. 6 shows a side view of the hairdressing razor from FIG. 5.
Figure 7:
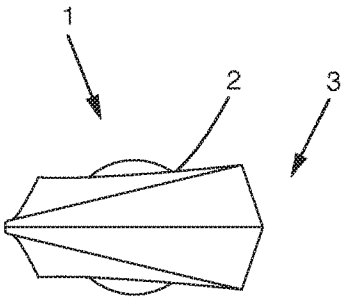
FIG. 7 shows a view of the hairdressing razor from FIG. 5 in the direction of arrow VII in FIG. 6.

The embodiments as shown in FIGS. 1 to 4, on the one hand, and FIGS. 5 to 7, on the other, differ in that the outer sides 17, 18 of the cutting head 3 are flat and parallel in FIGS. 5 to 7, while they are convexly curved in the embodiment of FIGS. 1 to 4 (compare FIGS. 3 & 7). Conversely, in the embodiment which is shown in FIGS. 9, the outer sides 17, 18 each have an elevation 19 and which runs in a curve roughly diagonally over the entire length of the cutting head 3. Here, the elevation 19 constitutes the highest point of each of the surfaces 17, 18. The surfaces descend toward the respective longitudinal side 6, 7 from the elevation 19. This execution promotes the sliding of the hair over the cutting head 3.

Figure 10:
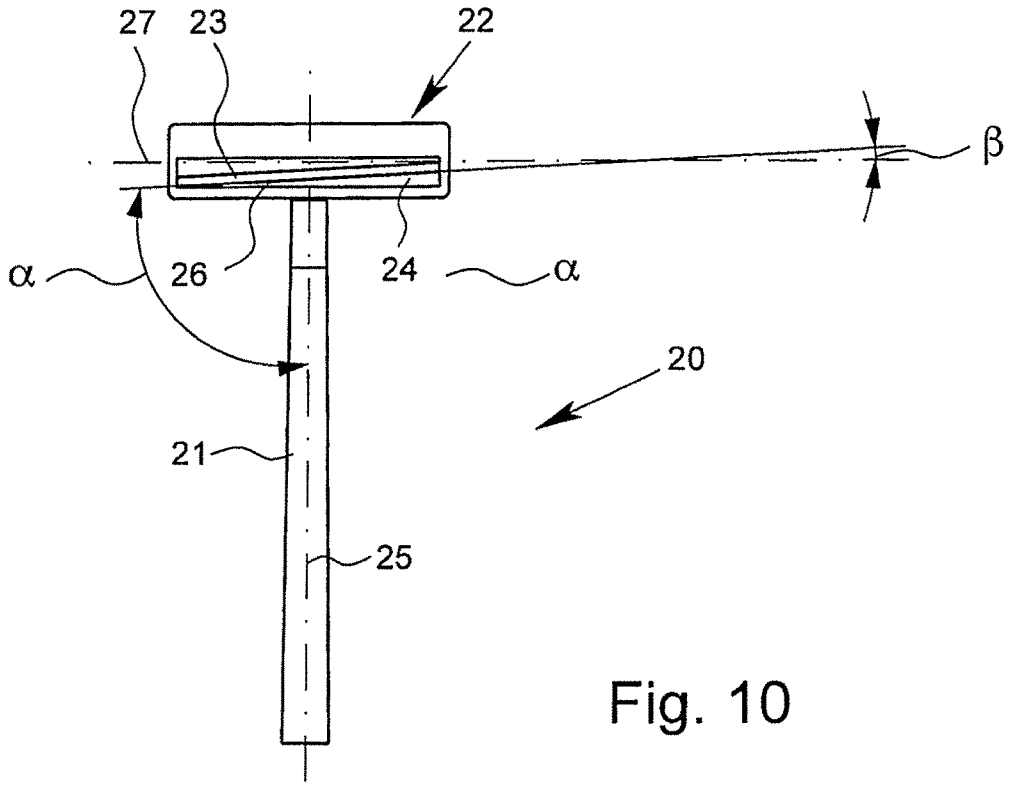
FIG. 10 is a front view of another embodiment of a shaving razor in accordance with the invention.
Figure 11:
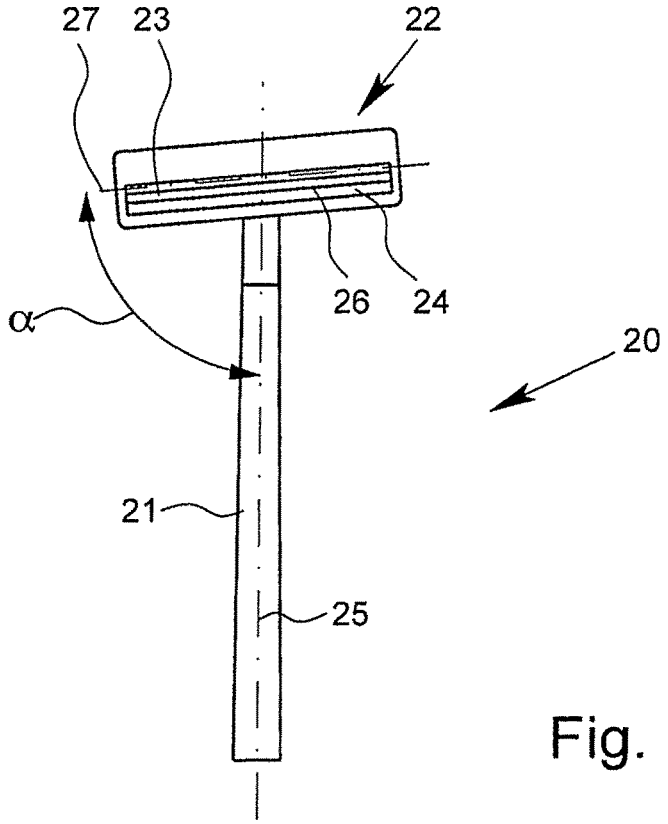
FIG. 11 shows a front view of still another embodiment of a shaving razor in accordance with the invention.

FIGS. 10 and 11 show two possible embodiments of shaving razors 20. First only the embodiment as shown in FIG. 10 is explained.

The shaving razor 20 is a disposable razor which enables manual shaving of body hair. The razor 20 has a handle 21 for grasping by the user, to which handle a shaving head 22 is permanently and undetachably connected in the exemplary embodiment as shown in FIG. 10.

However, quite generally, it can be stated that the invention is not limited to disposable razors with shaving heads which are connected permanently to the handle. In the same way, the invention relates to shaving razors, especially disposable razors, with interchangeable shaving heads which can be detachably connected to the handle. For this purpose, a locking or catch connection is used, for example, via hooks or the like, the connection conventionally being detachable via a corresponding actuating knob or grip on the handle. After the blade of the shaving head is worn down, the old shaving head is replaced by a new shaving head.

The following statements relate in the same way to shaving razors of the aforementioned type, therefore regardless of whether the shaving head is connected permanently to the handle or can be detachably connected to it.

The shaving head 22 which conventionally has an elongated shape, in this case the shape of an elongated rectangle, has at least one blade 23. The blade 23 is located fixed in the shaving head 22, therefore is connected undetachably to it and has only one cutting edge 26. Otherwise the blade 23 extends at least essentially over the entire length of the shaving head 22. Underneath the blade 23 is a slot 24 via which the cut stubble is routed from the front region of the shaving head 22 to the rear region of the shaving head 22 and thus at least essentially clears the forward region of the blade 23.

Figure 12:
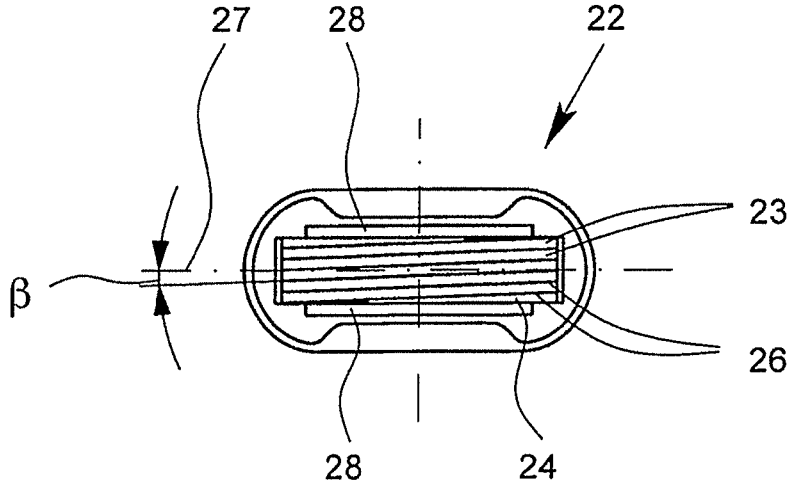
FIG. 12 shows a shaving head in accordance with the invention for a shaving razor.

FIG. 10 shows a very simple embodiment of a shaving head 22 with only one blade 23. Fundamentally the shaving head 22 can have a blade arrangement with a plurality of blades 23 which are then located preferably parallel to one another, as is shown in FIG. 12. The other blades 23 also then extend at least essentially over the entire length of the shaving head 22.

Furthermore, it is also fundamentally possible that on the front of the shaving head 22 underneath and/or above the blade or blades 23 there is at least one elastic element 28 (FIG. 12) which even with strong pressure of the shaving head 22 against the skin is designed to prevent unintentional cutting as much as possible.

The handle 21, in the embodiment which is shown in FIG. 10, has a plastic base body. The shaving head 22 also has a plastic base body in which the blade 23 is captively and undetachably located. In embodiments with a shaving head 22 which can be detachably connected, the handle 21 as such and/or the shaving head 22 as such can also be made of different materials.

It is important at this point that the longitudinal axis 25 of the handle 21 is located at an angle $\alpha$ not equal to 90° relative to the cutting edge 26 of the blade 23. This geometry is provided in the both of the embodiments of FIGS. 10 & 11.

In the embodiment of FIG. 10, the longitudinal axis 27 of the shaving head 22 is located at a right angle to the longitudinal axis 25 of the handle 21, while the cutting edge 26 is located at another angle $\beta$ to the longitudinal axis 27 of the shaving head 22. Here, the other angle $\beta$ between the cutting edge 26 and the longitudinal axis 27 of the shaving head 22 is fundamentally between 0.1° and 25°. Any individual value and any intermediate interval within the aforementioned range is possible. Thus intermediate intervals from 0.2° to 25°, 0.3° to 25°, 0.4° to 25°, 24.8° to 25 and 24.9° to 25° are as possible, as are intermediate intervals from 0.1° to 24.9°, 0.1° to 24.8°, . . . , 0.1° to 0.4°, 0.1° to 0.3°, and 0.1° to 0.2°. In particular, the aforementioned intermediate intervals also apply in the regional boundaries between 0.5° and 6° and mainly between 1° and 4°, therefore, for example, 1.1° to 3.9°, 1.2° to 3.8°, etc.

In the embodiment shown in FIG. 11, the longitudinal axis 27 of the shaving head 22 is at an angle $\alpha$ not equal to 90° to the longitudinal axis 25 of the handle 21, while the cutting edge 26 runs parallel to the longitudinal axis 27 of the shaving head 22. The angle α between the longitudinal axis 25 of the handle 21 and the longitudinal axis 27 of the shaving head 22 corresponds to the angle α between the longitudinal axis 25 of the handle 21 and the cutting edge 26. Here it is such that the angle α is found using the formula $$\alpha=90°-\beta$$

Since the angles α and β are interrelated, of course, the aforementioned region information, intermediate intervals and also individual values within the respective regional boundaries apply to the two angles α and β in the same way.

FIG. 12 shows a (disposable) shaving head 22 for detachable connection to a handle 21 which is not shown. The shaving head 22 has five blades 23 which are arranged parallel to one another. Each of the blades 23 has only one cutting edge 26. Furthermore, above and below the arrangement of blades 23 there is an elastic element 28 which projects over the edges 26 of the blades 23. The geometry of the blades 23 and of their cutting edges 26 relative to the longitudinal axis 27 of the shaving head 22 corresponds to the geometry of the cutting edge 26 of the shaving head 22 from FIG. 10 so that reference is made expressly to it.

It is not shown that a catch receiver which is supported in an articulated manner and into which a handle 21 can be inserted and locked is provided on the back on the shaving head 22.

Fundamentally, of course, it goes without saying that the catch receiver need not necessarily be supported in an articulated manner on the shaving head 22, but can also be rigidly attached to it.

What is claimed is:

1. A hairdressing razor for cutting of hair, comprising:

an elongated handle having a longitudinal axis, a cutting head having the shape of an elongated rectangle which is connected to the handle, a blade holder for holding a razor blade in a fixed position in the cutting head, said blade holder extending in a plane containing the longitudinal axis of the elongated handle, wherein the blade holder is constructed so as to position a longitudinal axis of a razor blade held in the blade holder parallel to the plane containing the longitudinal axis of the elongated handle at an angle of between 0.1° and 10° relative to the longitudinal axis of the elongated handle, wherein a first recess is provided on a first longitudinal side of the cutting head and a second recess is provided on a second longitudinal side of the cutting head, the first recess being located on an upper half of the cutting head and the second recess being located on a lower half of the cutting head, the first and second recesses being parallel to the plane containing the longitudinal axis of the elongated handle and into each of the first and second recesses a free cutting region projects without extending beyond a longitudinal edge of each of the first and second longitudinal sides when the razor blade is held in the blade holder, wherein the open side of each of the first and second recesses faces in a direction perpendicular to the longitudinal axis of the elongated handle and a length of an open side of each of the recesses along the longitudinal sides of the cutting head is smaller than half the length of the longitudinal sides, wherein a length of the free cutting region in the recess is between 1 and 10 mm, and a clear distance of the free cutting region relative to the longitudinal edge is greater than 1 mm, wherein the recesses are located offset relative to one another on the opposite sides of the cutting head and are thereby displaced along the longitudinal axis of the elongated handle, wherein the cutting head is adapted to enclose and thereby prevent access to the cutting regions of the razor blade except where the free cutting regions of the razor blade projects into the recesses, and wherein the cutting head has outer sides, the outer sides each have an elevation which runs in a curve diagonally over the entire length of the cutting head, the elevation constituting the highest point of each of the outer surfaces, the outer surfaces descending from the elevation to the respective longitudinal sides of the cutting head.

2. The hairdressing razor as claimed in claim 1, wherein the length of the free cutting region in the recess is between 3 mm and 8 mm, the maximum distance of the cutting region into the recess is between 1.6 mm and 3 mm, and wherein the clear distance of the cutting region relative to the longitudinal edge is between 1.5 mm and 3 mm.

3. The hairdressing razor as claimed in claim 1 wherein the cutting head comprises a lower cutting head part which is connected to the handle, and an upper cutting head part, wherein the at least one blade holder is located between the upper and lower cutting head parts, and wherein the upper cutting head part is a separate component that is detachably connected to the lower cutting head part.

4. The hairdressing razor as claimed in claim 1 wherein each of the first recess and second recess is sinuous, providing a rounded transition from the longitudinal edge of the longitudinal side to the recess and wherein the length of the recess is greater than the length of the free cutting region by the factor of at least 1.2.

5. The hairdressing razor as claimed in claim 1 wherein the longitudinal axis of the razor blade held in the blade holder is 0.5° and 6° relative to the longitudinal axis of the elongated handle.

6. The hairdressing razor as claimed in claim 1 wherein the longitudinal axis of the razor blade held in the blade holder is 2° and 4° relative to the longitudinal axis of the elongated handle.

7. The hairdressing razor as claimed in claim 1 wherein the cutting head has additional surfaces that are flat and parallel to each other.

8. The hairdressing razor as claimed in claim 1, wherein the cutting head is made in one piece and there is an insertion slot in the cutting head for pushing of the blade into the blade holder.

9. The hairdressing razor as claimed in claim 1, wherein the length of each of the first recess and the second recess is greater than the length of the free cutting region by a factor between 1.5 and 3.

10. The hairdressing razor as claimed in claim 1, wherein the blade holder is adapted to hold only one said blade with free cutting regions of the blade extending into each of the first recess and the second recess.

11. The hairdressing razor as claimed in claim 1, wherein the elongated handle has an elongated conical shape.

* * * * *